United States Patent [19]

Daussan et al.

[11] Patent Number: 4,854,550

[45] Date of Patent: Aug. 8, 1989

[54] STOPPER FOR RETAINING SLAG AND PROCESS FOR IMPLEMENTATION AND MANUFACTURE THEREOF

[75] Inventors: Jean C. Daussan, Metz; Gérard Daussan; André Daussan, both of Longeville-Les-Metz, all of France

[73] Assignee: Daussan et Compagnie, Woippy, France

[21] Appl. No.: 118,427

[22] Filed: Nov. 9, 1987

[30] Foreign Application Priority Data

Nov. 13, 1986 [FR] France ..... 86 15739

[51] Int. Cl.[4] ..... C21C 5/46

[52] U.S. Cl. ..... 266/45; 266/230

[58] Field of Search ..... 266/45, 227, 230, 272, 266/236; 164/82

[56] References Cited

U.S. PATENT DOCUMENTS

| | | | |
|---|---|---|---|
| 3,727,668 | 4/1973 | Griffiths | 164/82 |
| 4,526,349 | 7/1985 | Schwer | 266/227 |

FOREIGN PATENT DOCUMENTS

| | | | |
|---|---|---|---|
| 0128576 | 12/1984 | European Pat. Off. | 266/227 |
| 47-20803 | 6/1972 | Japan . | |
| 52-27009 | 1/1977 | Japan . | |
| 52-22602 | 6/1977 | Japan | 266/227 |
| 0071494 | 12/1982 | Luxembourg . | |
| 0646759 | 12/1981 | U.S.S.R. | 266/230 |

*Primary Examiner*—S. Kastler

*Attorney, Agent, or Firm*—Young & Thompson

[57] ABSTRACT

The stopper (1) is intended to automatically stop the orifice (14) of the pouring hole (11) of a metallurgical container (8) at the end of pouring of liquid metal (12) before the passage of slag (13).

It principally comprises an external envelope in a refractory insulating material which is capable of sintering inside the metallurgical container (8), and composed of inorganic refractory particles embedded in a binder and a heavy core (6) intended to give the stopper (1) a density such that it floats on the liquid metal (12) and is sufficiently submerged in the metal (12) in order to stop the orifice (14) of the pouring hole (11) before the passage of slag (13).

9 Claims, 3 Drawing Sheets

Figure 1:
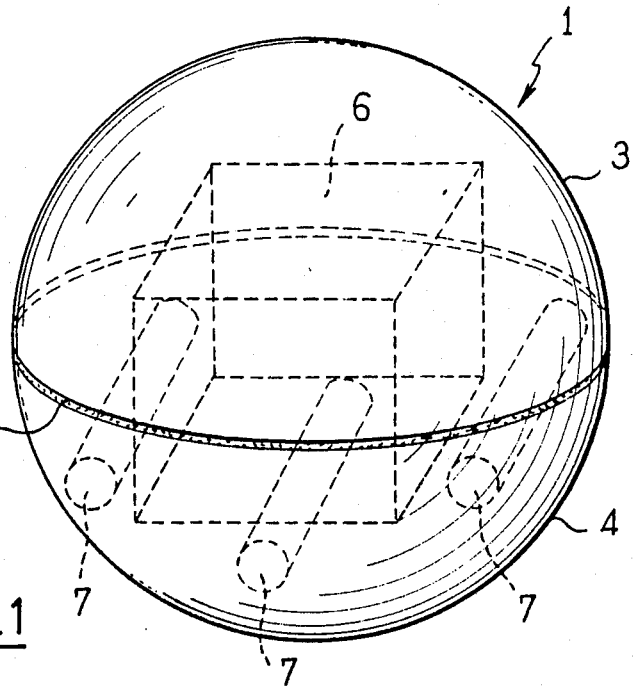

STOPPER FOR RETAINING SLAG AND PROCESS FOR IMPLEMENTATION AND MANUFACTURE THEREOF

The present invention relates to a stopper retaining slag inside a metallurgical container. This stopper is intended to block the pouring orifice of the container at the end of the pouring of the liquid metal contained in the container, but before the passage of slag through this orifice.

The invention also relates to a process for implementation of this stopper.

It is known that, in a metallurgical container containing liquid metal, such as a converter, a furnace, a casting ladle or a distributor, there is always a layer of slag which floats above the liquid metal. During pouring of the liquid metal, it is a constant concern of the metallurgist to prevent the passage of slag which may subsequently contaminate the poured metal. In order to avoid this contamination, the metallurgist stops the pouring orifice before the passage of slag.

In order to stop the pouring orifice, use is currently made of a ball in a material that is more dense than the liquid metal such as copper in the case of liquid steel. This ball has a diameter greater than the internal diameter of the pouring orifice. It is thrown into the metallurgical container at the end of pouring, and because of its density it sinks into the liquid metal, rolls on the bottom of the container and positions itself over the pouring orifice thereby stopping it. A copper ball of this type is expensive and difficult to use since it must not be thrown in too early, as this would entail a loss of metal, nor too late, as this would allow slag to pass through. In addition, the use of a copper ball of this type involves a risk of contaminating the liquid metal with copper.

In order to avoid the entrainment of slag after draining the converter, casting , ladle or distributor, sealing valves, slide valves and solid floats have also been proposed. Because of the geometrical variation of the pouring orifice during successive pourings of liquid metal, these constant-diameter solid floats do not guarantee convincing results with regard to stopping the flow of slag.

A refractory cement stopper in the shape of a funnel extended by a metal rod serving as a guide for a stopper of this type is also used. This stopper is suspended on the end of a tool bent back in the form of an open ring; it is released above the pouring orifice at what is considered to be the opportune moment in order to block the pouring orifice. The use of such a stopper is difficult and hard because the operator is obliged to remain very close to the metallurgical container so that he is exposed to a very intense heat.

The object of the invention is to remedy the disadvantages of known devices and to propose a stopper for retaining slag which is efficient, low in cost and very easy to use, and which enables the pouring orifice of a metallurgical container to be stopped at the end of the pouring of liquid metal contained in this container before the passage of slag and without risk of contamination of the metal.

According to the invention, this stopper comprises an external envelope produced in a thermally insulating refractory material which is capable of sintering at the temperature prevailing in the container and composed of inorganic refractory particles embedded in a binder and a heavy core intended to give the stopper a density such that it floats on the liquid metal but is sufficiently submerged in the metal to stop the pouring orifice at the end of pouring before the passage of slag.

The stopper according to the invention is entrained automatically towards the pouring orifice by the currents created in the liquid metal such that the use of this stopper requires no personnel in the vicinity of the metallurgical container.

Because the inorganic particles sinter in contact with the liquid metal, the external envelope of the stopper according to the invention retains its mechanical cohesion whilst being slightly malleable throughout the duration of its residence in the liquid metal. Given that the density of the material of which this envelope is composed is less than that of the liquid metal, this material floats on the surface of the latter. By virtue of the heavy core, it is possible to regulate the depth of immersion of the stopper in the liquid metal and to determine the depth of liquid metal and of slag which will remain in the bottom of the metallurgical container when the stopper blocks the pouring orifice.

According to an advantageous embodiment of the invention, the envelope is formed by two hollow substantially hemispherical half-shells, assembled using a refractory adhesive.

These hollow half-shells can be produced easily by molding and allow the heavy core to be easily positioned.

According to another embodiment of the invention, the insulating material in which the envelope is produced has a composition and a particle size such that its density is between 0.5 and 2.9 kg/dm$^2$. This density is clearly less than that of the liquid steel. Consequently, it is possible to easily regulate the depth of immersion of the stopper in the liquid steel by means of the heavy core.

According to a preferred embodiment of the invention, the heavy core is of metal and has the shape of a cube or of a right-angled parallelepiped. The core is preferably arranged in the center of the stopper and additional ballast means are advantageously provided in one of the half-shells in order to lower the center of gravity of the stopper.

Therefore, the stopper is prevented from turning about itself under the effect of eddies created in the liquid metal.

The process according to the invention consists in placing a stopper of the abovementioned type and the lower part of which is submerged in the bath of metal below the bed of slag in a metallurgical container containing liquid metal.

Other special features and advantages of the invention will become apparent in the following description.

Figure 2:
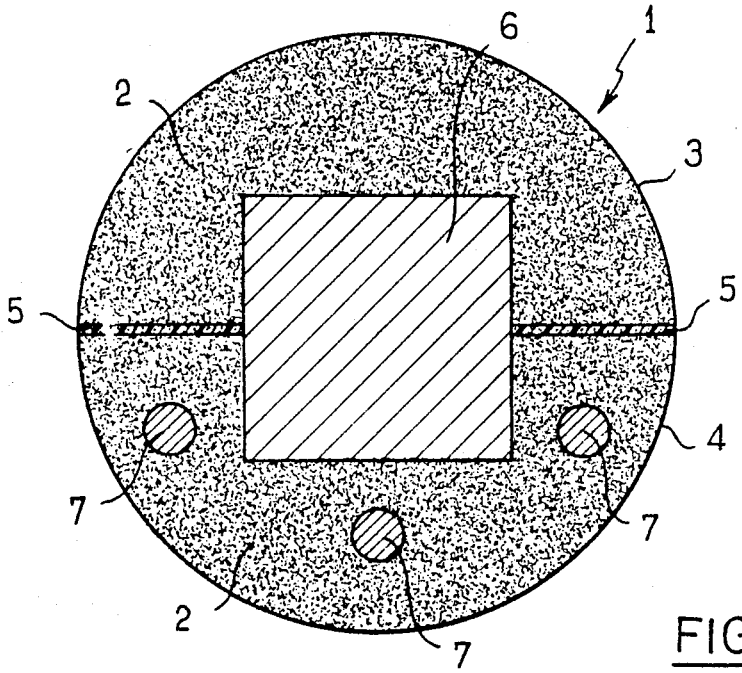
Figure 3:
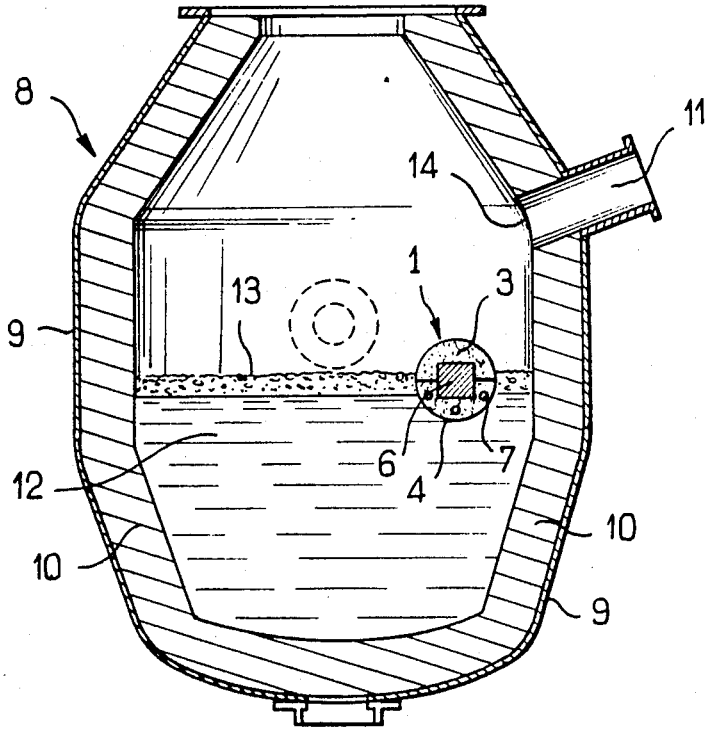
Figure 4:
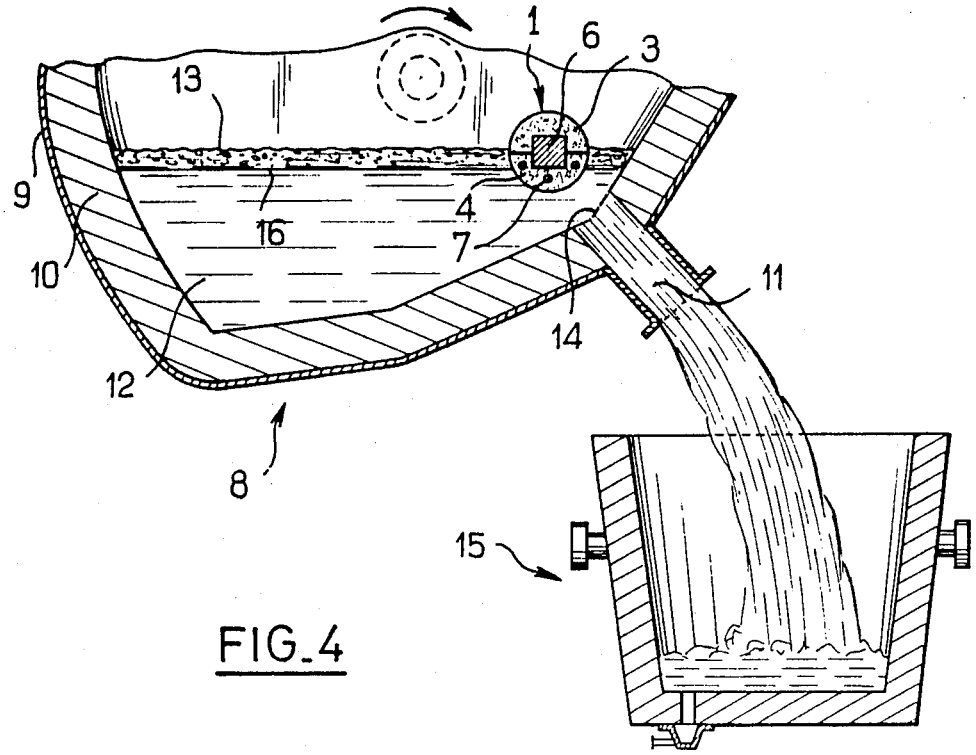
Figure 5:
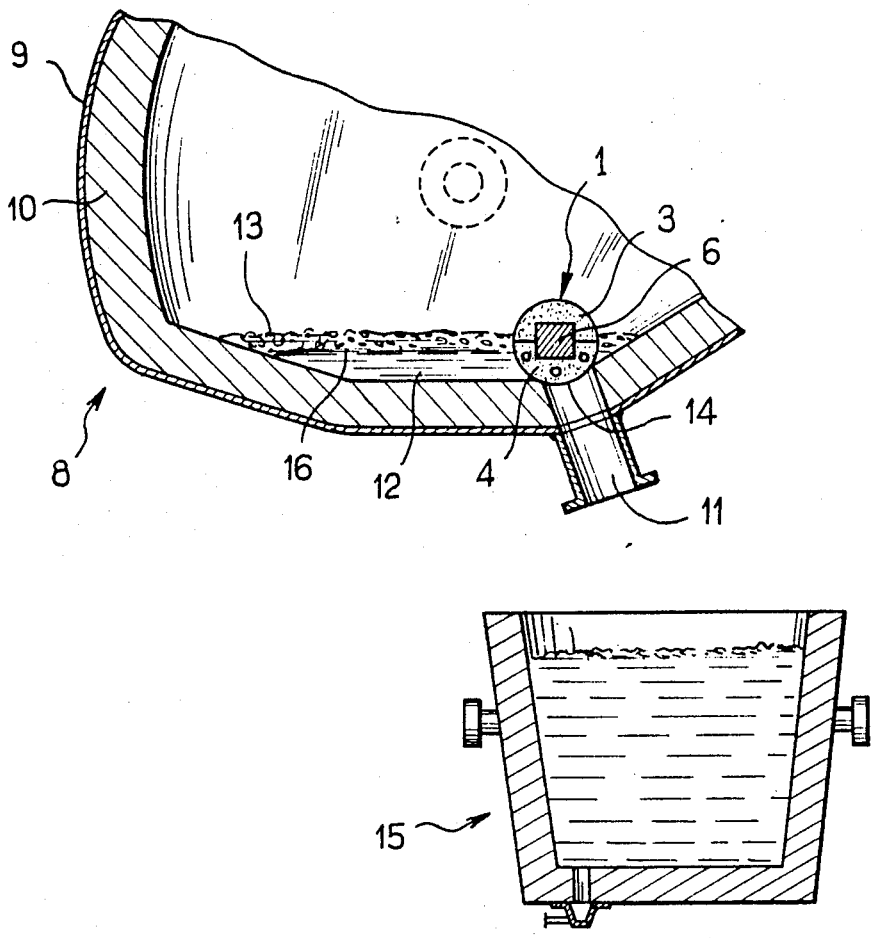

In the attached drawings which are given by way of example and which are not limiting:

FIG. 1 is a general perspective view of an embodiment of a stopper according to the invention, FIG. 2 is a view in cross-section according to a diametrical plane of the stopper of FIG. 1, FIG. 3 is a view in vertical axial section of a converter in an erect position inside which a stopper according to the invention has been introduced, FIG. 4 is a view in vertical axial section of the converter of FIG. 3 in a partially tilted position allowing the pouring of metal into a casting ladle, FIG. 5 is a view in vertical axial section similar to FIG. 4 showing the converter in a completely tilted position at the end of pouring at the moment when the stopper blocks the pouring orifice.

In the embodiment shown in FIGS. 1 and 2, the substantially spherical stopper 1 comprises an envelope 2 formed by two half-shells 3, 4, which are hollow and assembled by means of a refractory adhesive 5, surrounding a heavy core 6, for example in metal, having the shape of a cube or of a right-angled parallelepiped with square cross-section, and which may be a section of billet.

The two hollow half-shells 3, 4 are produced in a thermally insulating refractory material composed of inorganic refractory particles such as silica and/or alumina and/or magnesium oxide, and the like and optionally of organic and/or inorganic fibers, the whole being agglomerated by means of an organic and/or inorganic and/or synthetic binder and which are capable of sintering at the temperature prevailing in the metallurgical container.

The composition of the material and the particle size of the constituents are adjusted such that sintering is produced, in the case of steel metallurgy, between 800° C. and 1,500° C. The density of this material may vary between 0.5 and 2.9 kg/dm$^3$ as a function of the composition and of the particle size of its constituents.

The diameter of the stopper 1 is adapted to the diameter of the pouring orifice of the metallurgical container which has to be blocked, taking account of possible wear of the refractory lining which surrounds this pouring orifice.

The dimensions and the nature of the core 6 are adapted to the diameter and to the composition of the envelope 2 such that the density of the stopper 1 is such that the latter floats on the liquid metal and is sufficiently submerged in the metal in order to stop the orifice of the pouring hole at the end of pouring before the passage of slag into the latter.

Consequently, in the case of steel metallurgy, the density of the stopper 1 is advantageously between 3 and 6.5 kg/dm$^3$, and is preferably equal to or greater than 3.8 kg/dm$^3$. The core 6 is advantageously produced in steel.

It may be advantageous to provide additional ballast means 7 in the half-shell 4 in order to lower the center of gravity of the stopper 1 and to maintain this half-shell 4 permanently in a low position. In this way it is possible to prevent the stopper 1 rolling on itself. These additional ballast means 7 may advantageously be formed by sections of metal bars embedded in the mass of the half-shell 4 or, alternatively, at least for a part of them, welded to the core 6, for example to the inner face of the latter so as to exert a maximum restoring force. In this way, the general arrangement of the two half-shells 3, 4 in the horizontal position is maintained under all conditions.

FIGS. 3, 4 and 5 show a converter 8 which comprises, in a known manner, an outer envelope in steel 9, a refractory lining 10, a pouring hole 11 opening out into the inside of the refractory lining 10 by means of a pouring orifice 14.

The converter 8 is shown on FIG. 3 in an erect position. The converter 8 contains liquid metal 12 which is ready to be poured and which has a layer of slag 13 floating on top. A stopper 1 for retaining slag 13, according to the invention, has been introduced inside the converter and is floating on the liquid metal 12 and is partially submerged in the metal.

As soon as the stopper 1 is introduced inside the converter 8, the insulating material located on the periphery of the two hollow half-shells 3, 4 begins to sinter due to the ambient temperature. This sintering continues inside stopper 1 as a function of the increase in temperature within the stopper 1.

By virtue of this sintering, the material maintains its cohesion despite the decomposition of the binder. Moreover, it has been observed that the liquid metal does not moisten the surface of the stopper and the slag 13 does not attach itself to the latter. Consequently, the behavior of the stopper 1 up to the end of pouring does not risk being disturbed by undesirable adhesion of metal or of slag which can modify the depth of immersion of the stopper.

In order to pour the liquid metal 12 from the converter 8 into a second metallurgical container formed in the example of FIG. 4 by a casting ladle 15, the converter 8 is tilted in a known manner in the direction of the arrow so that the liquid metal 12 flows through the pouring hole 11 into the casting ladle 15 as shown in FIG. 4.

The upper level 16 of the metal is always kept well above the level of the pouring orifice 14. The stopper 1 floats on the liquid metal 12 and is slightly submerged in the metal so that the lower part of the shell 4 is below the upper surface 16 of the metal.

When the pouring of the liquid metal 12 has been completed, the converter 8 being in the totally tilted position shown in FIG. 5, the upper level 16 of the liquid metal 12 is still located above the level of the pouring orifice 14. On the other hand, the stopper 1 which is partially entrained by the metal 12 flowing through the pouring hole 11, has permanently remained in position above the pouring orifice 14. At a certain moment, the shell 4 whose lower part is below the bed of slag 13 will block the pouring orifice 14 and stop the flow of metal 12 just before the passage of slag 13.

It is important to give the stopper 1 a density and a diameter which are appropriate to the geometry of the converter, to that of the pouring orifice and also to the supposed thickness of the layer of slag so that, when the pouring orifice 14 is blocked by the shell 4, not only can no slag pass through, but there also remains in the converter the quantity of metal 12 that is just sufficient to ensure automatic stopping.

The composite structure of the stopper 1 provided by the invention makes it easy to fulfill such specifications.

Therefore, for a pouring orifice with an internal diameter of 200 mm, a spherical stopper 1 has been envisaged which has a diameter equal to 235 mm containing a core 6 of steel in the shape of a right-angled parallelepiped having a height of 160 mm and a square cross-section with a side of 130 mm, a mass of 19.5 kg, the two hemispherical half-shells 3, 4 being produced by pressing or by filtration accelerated by increased or reduced pressure using a material such as that described above with a density of approximately 1.6 kg/dm$^3$, i.e. a mass of 6.5 kg for a volume of 4 dm$^3$ approximately, the lower half-shell 4 having more ballast by means of sections 7 of a steel bar having a diameter of 25 mm representing a total length of 130 mm and a total mass of 0.5 kg. At least one of these sections may be welded to the inner face of the core 6.

The stopper thereby produced has a mass of 26.5 kg for a total volume of 6.8 dm$^3$, i.e. a density of approximately 3.8 kg/dm$^3$.

It is particularly easy to use the stopper according to the invention. In fact, it is sufficient to throw it into the metallurgical container and it needs no supervision after that so there is no need for any personnel in the vicinity of the metallurgical container to be exposed to an intense and uncomfortable heat. The stopper material has a certain sintering rate. It therefore sinters beginning at its surface and then becomes refractory at the surface, but not at the core. After use, the stopper disintegrates and therefore does not interfere with the subsequent operations.

Obviously, use of the stopper according to the invention is not limited to the example described. Such a stopper may obviously be used in metallurgical containers other than converters such as casting ladles and continuous casting tundishes. Such a stopper may also be used in the metallurgy of metals other than steel, such as aluminum, copper and alloys thereof, the density of the stopper in this case being adapted to that of the liquid metal in question and the composition of the insulating material of the envelope and the nature of the constituents being adapted so that sintering occurs at a temperature which is substantially less than the temperatures prevailing inside the metallurgical containers in question.

Similarly, the shape and the composition of the core 6 and of the additional ballast means 7 may be modified without departing from the scope of the present invention. In particular, it is possible to move the core 6 off the center relative to the center of the stopper which removes the need for additional ballast means 7. The shells 3 and 4 may also have different shapes and/or unequal volumes. It is also possible to use sections 7 of bar having a cross-section that is square or rectangular and no longer round, or to use for the lower half-shell 4 a material composed of inorganic particles which are more dense than those of the upper half-shell 3 or, alternatively, to have an upper half-shell which is more dense than the lower one.

The process of manufacture using accelerated filtration makes it possible, if required, to manufacture the stopper in one piece whilst incorporating beforehand the mass of ballast inside the mold.

The process of manufacture by accelerated filtration of sediments which are to form the stopper also makes it possible to produce it with a substantially central recess by incorporating, therein a product of the "hard wax" type used in casting, or using a polystyrene element, for example on which liquid steel will be poured in the steel works in order to weight the said stopper on site and at a satisfactory price.

We claim:

1. Process for blocking a metallurgical container containing liquid metal and with slag floating on top at the end of pouring, consisting in placing in the said container a floating stopper the lowest part of which is submerged in the bath of metal below the bed of slag, the stopper comprising an external envelope (2) which is substantially spherical, and is produced in an unsintered slightly malleable thermal refractory insulating material which sinters at the temperatures prevailing in the container (8) and composed of inorganic refractory particles embedded in a binder and a heavy core (6) giving the stopper (1) a density such that it floats on the liquid metal (12) and is sufficiently submerged in the metal (12) to stop the pouring orifice (14) at the end of pouring before the passage of slag (13), the exposed outer surface of the stopper consisting of said unsintered slightly malleable thermal refractory insulating material.

2. Stopper (1) for retaining slag (13) inside a metallurgical container (8), stopping automatically the pouring orifice (14) of the container (8) at the end of the pouring of the liquid metal (12) contained in this container (8) before the passage of slag (13) floating above the liquid metal (12), which comprises an external envelope (2) which is substantially spherical, and is produce in an unsintered slightly malleable thermal refractory insulating material which sinters at the temperatures prevailing in the container (8) and composed of inorganic refractory particles embedded in a binder and a heavy core (6) giving the stopper (1) a density such that it floats on the liquid metal (12) and is sufficiently submerged in the metal (12) to stop the pouring orifice (14) at the end of pouring before the passage of slag (13), the exposed outer surface of the stopper consisting of said unsintered slightly malleable thermal refractory insulating material.

3. Stopper as claimed in claim 1, wherein the envelope (2) is formed by two hollow half-shells, assembled using a refractory adhesive (5).

4. Stopper as claimed in claim 1 , wherein the insulating material in which the envelope (2) is produced has a composition and a particle size such that its density is substantially between 0.5 and 2.9 kg/dm$^3$.

5. Stopper as claimed in claim 1, wherein the heavy core (6) is of metal and has the shape of a cube or of a parallelepiped.

6. Stopper as claimed in claim 5, wherein the core (6) is arranged in the center of the stopper (1) and wherein additional ballast means (7) are provided in one (4) of the half-shells (3, 4) in order to lower the center of gravity of the stopper (1).

7. Stopper as claimed in claim 6, wherein the additional ballast means (7) are formed by one or more sections of metal bar.

8. Stopper as claimed in claim 1, for use in metallurgical containers containing liquid steel, wherein the density of the stopper (1) is between 3 and 6.5 kg/dm$^3$ and wherein the insulating material forming the envelope (2) has composition such that sintering occurs between 800° C. and 1,500° C.

9. Stopper as claimed in claim 8, wherein the density of the stopper (1) is substantially equal to 3.8 kg/dm$^3$.

* * * * *